US006443477B2

(12) United States Patent
Bardin

(10) Patent No.: US 6,443,477 B2
(45) Date of Patent: Sep. 3, 2002

(54) SKI BINDING WITH A DEMOUNTABLE BRAKE

(75) Inventor: Roland Bardin, Varennes Vauzelles (FR)

(73) Assignee: Look Fixations, S.A., Nevers (FR)

( * ) Notice: Subject to any disclaimer, the term of this patent is extended or adjusted under 35 U.S.C. 154(b) by 0 days.

(21) Appl. No.: 09/768,963

(22) Filed: Jan. 24, 2001

(30) Foreign Application Priority Data

Feb. 2, 2000 (FR) ..... 00 01294

(51) Int. Cl.[7] ..... A63C 5/00
(52) U.S. Cl. ..... 280/605; 280/28.11; 188/5
(58) Field of Search ..... 280/604, 605, 280/611, 28.11; 188/5

(56) References Cited

U.S. PATENT DOCUMENTS

| | | | | |
|---|---|---|---|---|
| 3,930,659 A | | 1/1976 | Salomon | |
| 3,992,030 A | | 11/1976 | Salomon | |
| 4,083,576 A | * | 4/1978 | Besser | 280/605 |
| 4,230,337 A | | 10/1980 | Storandt | |
| 4,305,604 A | | 12/1981 | Leichfried | |
| 4,830,393 A | * | 5/1989 | Salomon | 280/605 |
| 5,004,065 A | * | 4/1991 | Goud | 280/605 |
| 5,324,062 A | * | 6/1994 | Rigal et al. | 280/605 |
| 5,362,086 A | | 11/1994 | Baron et al. | |
| 6,022,039 A | | 2/2000 | Chevalier | |
| 6,073,955 A | | 6/2000 | Chonier | |

FOREIGN PATENT DOCUMENTS

| | | | |
|---|---|---|---|
| DE | 2627365 | * | 4/1977 |
| DE | 2632874 | * | 1/1978 |
| DE | 2811734 | * | 9/1979 |
| FR | 2265420 | | 10/1975 |
| FR | 2383681 | | 10/1978 |
| FR | 2779971 | | 12/1999 |

OTHER PUBLICATIONS

Abstract of French Patent 2,668,941, published May 21, 1992.

* cited by examiner

*Primary Examiner*—Brian L. Johnson
*Assistant Examiner*—Bryan Fischmann
(74) *Attorney, Agent, or Firm*—Burr & Brown

(57) ABSTRACT

A ski binding comprises a slide (2) fixed on the ski and a sliding base (4). The binding is equipped with a ski brake which can be demounted and remounted. The brake has rigid retention means in the form of two hooks (23, 24). The two hooks engage, by virtue of a longitudinal (L) then transverse (T) engagement movement, two projections (33, 34) located on a reinforcement frame (31) fastened to the base (4).

25 Claims, 3 Drawing Sheets

FIG_1
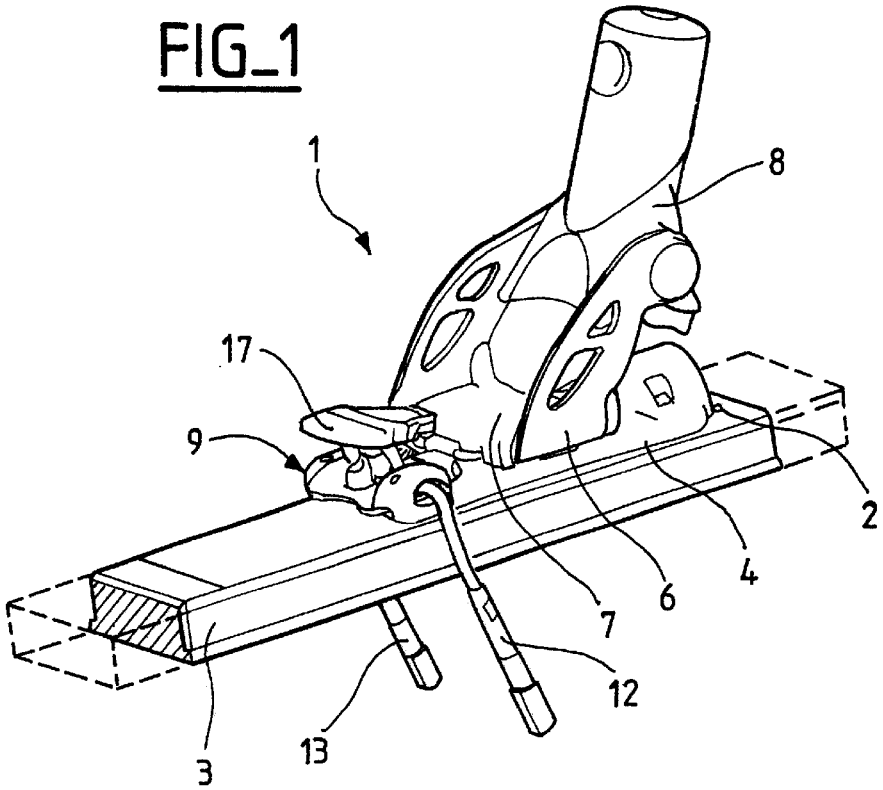
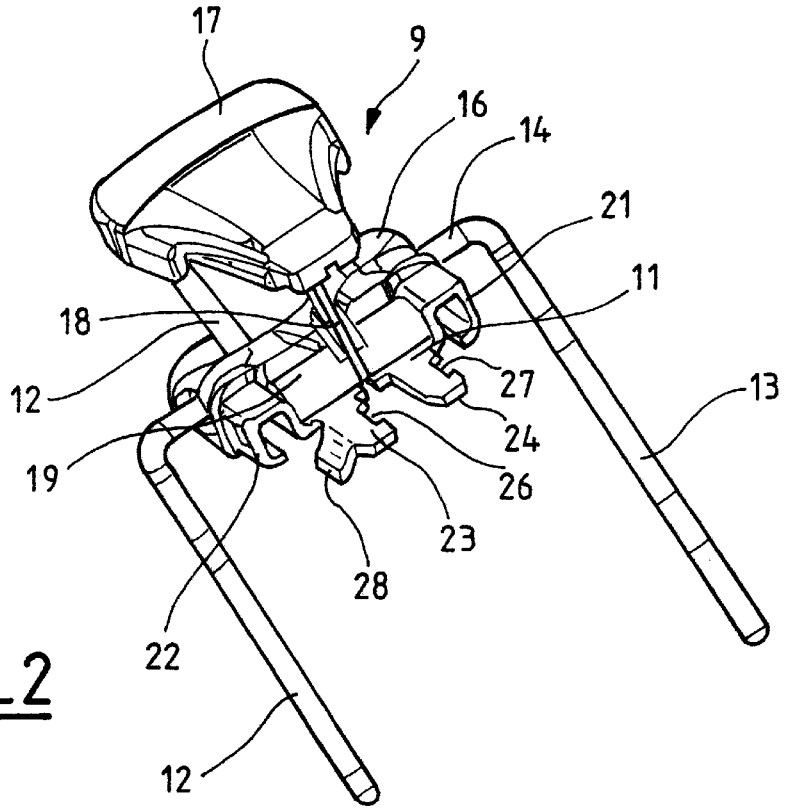
FIG_2

SKI BINDING WITH A DEMOUNTABLE BRAKE

The present invention relates to a ski binding equipped with a demountable ski brake which can be remounted.

In order to regrind ski edges, it is necessary to be able to remove the ski brake because the brake arms hamper this operation. Furthermore, as a result of great stresses on the ski run, the brake arms may break, become deformed or wear. It is therefore necessary to be able to demount and then remount the ski brake.

STATE OF THE ART

FR 2,668,941, FR 2,265,420, FR 2,692,804 and FR 2,741,275 disclose a ski binding, comprising a base, equipped with a demountable ski brake having a brake frame. The ski brake is always assembled with the base by means of one or more screws.

From FR 2,383,681, a ski binding is known, which comprises a front stop and a ski brake with its sole. The sole of the ski brake is extended by two flexible tabs which engage in the hollow base of the stop. These two tabs each have a stud which snaps into an aperture formed in the base of the stop.

Also known, from FR 2,447,732, is a ski binding comprising a base equipped with a demountable ski brake having a brake frame. The brake frame is extended by a flexible strip comprising two stop pins which can be accommodated, by snapping in, in two corresponding bores provided in the base.

FR 2,779,971 describes a ski binding comprising a base equipped with a demountable ski brake having a brake frame having rigid retention means. The rigid retention means are attached simply by axial thrust to a movable bolt returned by a spring.

The disadvantages of the mounting and demounting devices of the prior art are that the ski brake is fastened to the binding by screws which may be lost. Moreover, the screws are screwed and unscrewed and are worn away and wear away the thread. The other ski brake fastenings utilizing flexible parts or parts with a spring are more complicated to manufacture, and there is a risk of these same flexible parts or parts with a spring breaking, and untimely displacement and twisting may even occur during use on the ski run.

SUMMARY OF THE INVENTION

The aim of the invention is to overcome the abovementioned disadvantages by producing a mountable and demountable ski brake with excellent retention on a base of the binding.

The problem faced consists in providing means of retention of the ski brake which interact in a simple and secure manner with a complementary element present on the base.

A ski binding, comprising a base which slides on a slide mounted on the ski, and equipped with a demountable ski brake, has a brake frame having rigid retention means.

The present ski binding is characterized in that the rigid retention means engage, by virtue of a longitudinal then transverse engagement movement, a fixed element integrated with the base.

Depending on the position of the fixed element, the base can comprise a channel so as to facilitate the engagement displacement of the brake frame. However, to ensure lateral retention of the brake frame during use, the channel is preferably closed by the slide. The retention part of the brake frame can comprise at least one tab, preferably two tabs, shaped like a hook with an engagement notch. These two tabs are, for example, plane and arranged parallel to the plane of the base so as to be capable of engaging therein.

The fixed element intended to interact with the tab(s) advantageously comprises a number of projections corresponding to the number of tabs, preferably two projections. These projections are, by way of example, oriented perpendicularly in relation to the plane of the base. The free end of the projections will preferably fit into the structure of the base so as to improve their own resistance to being wrenched out. In this way, the hooks will not be able to come out of engagement with the projections in the event of an undesired vertical displacement of these hooks.

To improve further the local rigidity of the binding in this region, the binding can comprise a reinforcement frame fastened to the base so as to delimit a housing. The two tabs engage in this housing before engaging the two projections. In this case, the reinforcement frame also bears the two projections which pass through this housing.

In order to avoid rotational movements of the ski brake in the event of lateral impact, a supplementary protuberance can be provided on one tab of the brake frame, which protuberance is arranged on the side without a notch, which side faces outwards. The protuberance will butt against a slide on the ski. By virtue of this taking up of play in the lateral direction, the tabs cannot come out of the projections in the event of untimely vibrations, if the binding is mounted on the slide.

DESCRIPTION OF THE DRAWINGS

The invention will be explained, and its advantages and various characteristics will emerge more clearly from the description below of a non-limiting exemplary embodiment, with reference to the appended drawings included by way of illustration, in which:

FIG. 1 shows a perspective view of a binding mounted on a ski and equipped with its demountable brake;

FIG. 2 shows a perspective view of the ski brake in the demounted state;

DETAILED DESCRIPTION OF THE INVENTION

Figure 3:
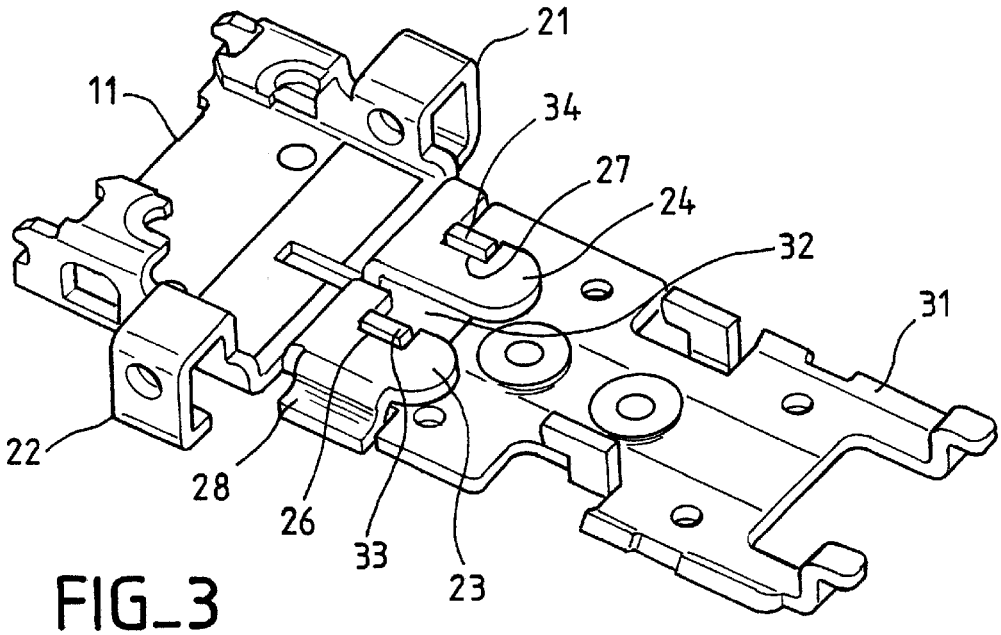
FIG. 3 shows a ski brake frame engaged on a reinforcement frame of a binding base.
Figure 6:
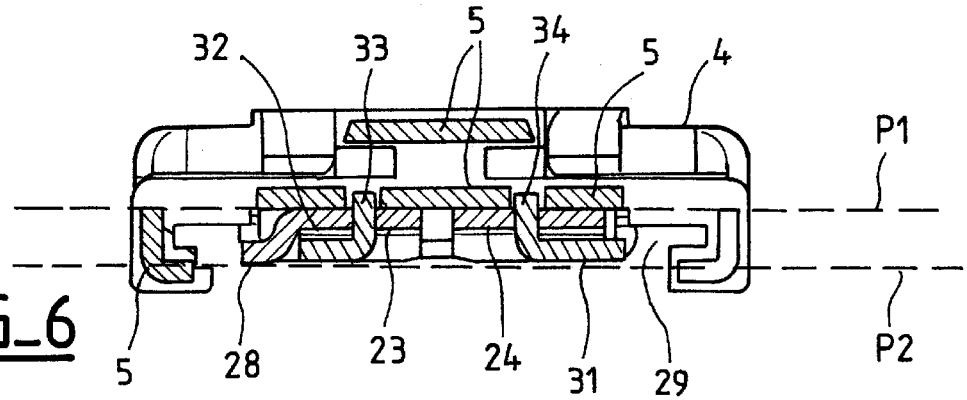
FIG. 6 shows a transverse section along the line VI—VI in FIG. 4.
Figure 7:
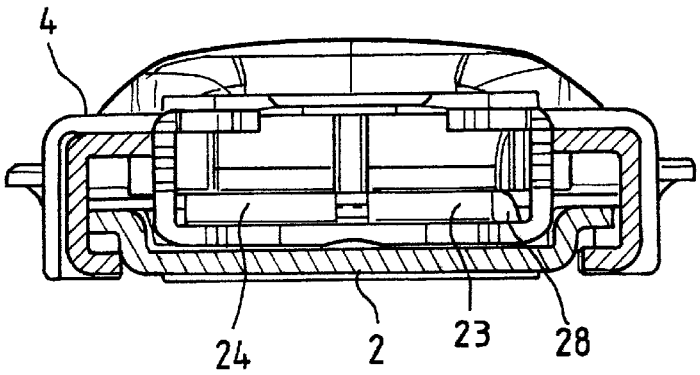
FIG. 7 shows a transverse section along the line VII—VII in FIG. 5.

A ski binding 1 comprises a slide 2 fixed on a ski 3 and, mounted in a sliding manner on the slide 2, a base 4 allowing the mounting of the other parts of the binding. The base 4 is a part made of plastic material comprising metal reinforcement parts 5. Mounted on the base 4 is a stirrup 6 which can pivot on the base 4 in relation to a vertical axis. A support plate 7, intended for the positioning of the heel of the ski boot, covers the stirrup 6. A body 8 serving as a heel-grip and release handle is articulated on the stirrup.

The binding is equipped with a brake 9 attached, so as to be capable of being mounted and demounted, to the end of the base 4. This brake 9 comprises a brake frame 11, on which two brake arms 12, 13 are articulated, which have an essentially horizontal intermediate portion 14 passing through holes formed in lateral cheeks of the frame 11 and serving as bearings for the brake arms 12, 13. The frame 11 is itself mounted in a moulded part 16 which is likewise passed through by the brake arms and the shape of which has a cam function for controlling the lowering and raising movement of the brake arms. The upper ends of the brake arms 12 and 13 are articulated under a brake pedal 17 which is also articulated on the brake frame 11 by means of a small rod 18. A spring 19 tending to raise the pedal 17, that is to say to maintain the brake arms 12 and 13 in the lowered position, acts on the small rod 18.

The brake frame 11 has two curved lateral wings 21 and 22, in which the slide 2 slides, so that the brake frame 11 is held in place and guided by the slide 2 in a similar manner to the base 4 of the binding. Moreover, the brake frame 11 has a retention part in the form of two tabs 23, 24 arranged parallel to the plane of the base 4 of the binding, that is to say to the plane of the slide 2. These tabs 23, 24 are of generally plane rectangular shape and each have at the side a notch 26, 27 respectively.

The tab 23 which has its smooth side facing outwards also comprises a protuberance 28 positioned on this side opposite the notch 26 and extending essentially downwards from the plane of the said tab 23.

In the region of the stirrup 6 and the brake 9, a first plane P1 defined by the lower internal surface of the base 4 of the binding is offset vertically in relation to a second plane P2 corresponding to the sliding of the slide 2, so as to form a free volume 29 of essentially parallelepipedal general shape. In this volume 29, a generally metal, flat reinforcement frame 31 is mounted parallel to the base 4, for example by riveting, and delimits, with the aid of perpendicular fixings, a housing 32 between the reinforcement frame 31 and the first plane P1 of the base 4.

The reinforcement frame 31 also comprises two fixed projections 33, 34 which are oriented perpendicularly in relation to the plane of the reinforcement frame 31 and therefore in relation to the plane of the base 4. The two projections 33, 34 are in the form of two small right-angled parallelepipeds which are directed towards the base 4. The two projections 33, 34 are of sufficiently great size in the longitudinal direction to withstand wrenching forces of the brake 9 in the longitudinal direction, for example when two skis are put together as a pair for transport.

The shape of the projections 33, 34 corresponds to the shape of the notches 26, 27 of the tabs 23, 24. The two projections 33, 34 extend into the base 4 and fit into the structure of the base 4.

The housing 32 has an opening at the front, which allows the passage of the two tabs 23, 24 with very limited play.

The base 4 also comprises a lateral channel 36 in the form of a cutout made in the slide of the base 4.

Figure 4:
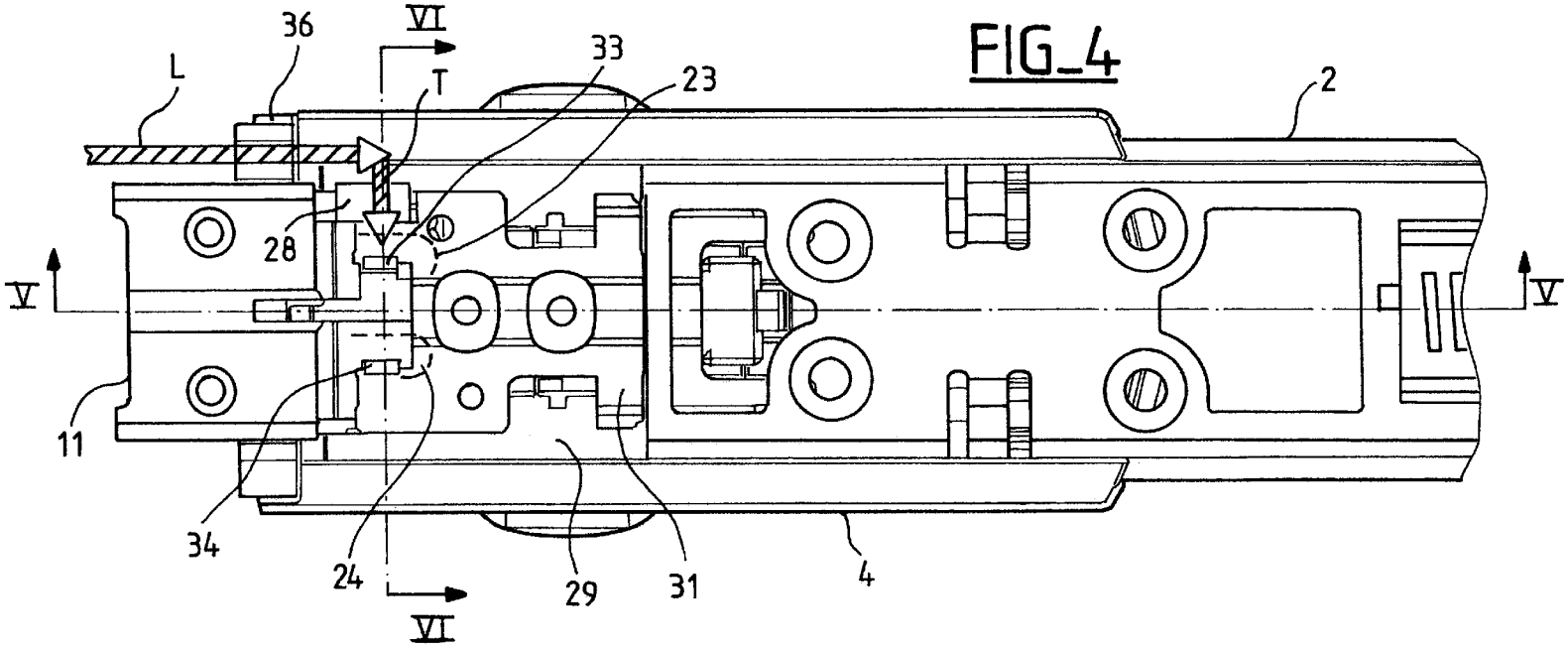
FIG. 4 shows a view of the bottom of a base with a brake frame and a partly inserted slide.
Figure 5:
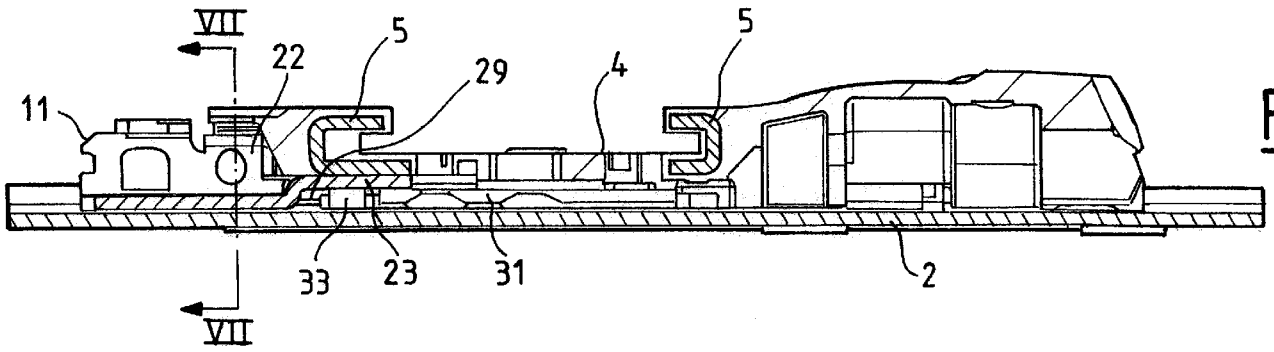
FIG. 5 shows a longitudinal section along the line V—V in FIG. 4, but with the slide completely inserted into the base.

Mounting of the brake 9 on the base 4 of the binding 1 is performed initially by pushing with a longitudinal engagement movement (arrow L in FIG. 4), followed by displacement with a transverse movement (arrow T in FIG. 4). This longitudinal movement L is performed with the brake 9 offset laterally in order that the end of the tabs 23, 24 does not butt against the projections 33, 34. The longitudinal movement L allows the brake frame 11 to pass through the lateral channel 36, and then, at the end of the travel, the tabs 23, 24 are positioned opposite the projections 33 and 34 respectively. The transverse movement T causes the notches 26 and 27 of the tabs 23 and 24 respectively to butt against the corresponding projections 33 and 34 respectively. Lateral locking of the brake 9 is then brought about by the slide 2 when the assembly consisting of the brake 9 and the base 4 is finally engaged on the slide 2.

Conversely, demounting of the brake 9 from the base 4 of the binding is carried out by initially separating the assembly consisting of the brake 9 and the base 4 from the slide 2, and then displacing the brake 9 with a transverse movement, and finally by pulling the brake 9 with a longitudinal extraction movement.

Any untimely demounting of the brake 9 in the event of lateral impact on the brake arms 12, 13 is avoided in either one lateral direction, by the projections 33, 34 fitting into the notches 26, 27 of the tabs 23, 24, or the other lateral direction, by the protuberance 28 of the tab 23 butting against the slide 2 of the ski.

The ski binding with its demountable brake is not limited to the embodiment described and illustrated. In particular, the number, arrangement and shape of the tabs 23, 24, the notches 26, 27 and the projections 33, 34 can vary. The projections 33, 34 could equally protrude directly from the base 4.

What is claimed is:

1. Ski binding, comprising a base which slides on a slide mounted on the ski, and equipped with a demountable ski brake having a brake frame having rigid retention means, wherein the rigid retention means engage a fixed element integrated with the base, by virtue of a longitudinal engagement movement of the brake frame and then a transverse engagement movement of said brake frame.

2. Binding according to claim 1, characterized in that the base comprises a lateral channel intended to allow the longitudinal engagement of the brake frame, and in that the said lateral channel is closed by the slide, ensuring lateral retention of the brake frame.

3. Binding according to claim 1, characterized in that the rigid retention means of the brake frame comprises one or more tabs shaped like a hook with a notch.

4. Binding according to claim 3, characterized in that the rigid retention means of the brake frame comprises two plane tabs arranged parallel to the plane of the base.

5. Binding according to claim 1, characterized in that the fixed element integrated with the base comprises one or more projections oriented perpendicularly in relation to the plane of the base.

6. Binding according to claim 5, characterized in that the fixed element comprises two essentially parallelepipedal projections.

7. Binding according to claim 5, characterized in that the free end of the projection or projections fits into the structure of the base.

8. Binding according to claim 3, characterized in that the base also comprises a reinforcement frame fastened to the base so as to delimit a housing in which the tabs engage by insertion.

9. Binding according to claim 8, characterized in that the reinforcement frame bears the fixed element integrated with the base, the fixed element extending through the housing.

10. Binding according to claim 3, characterized in that one of the tabs also comprises a supplementary protuberance which is arranged on the external side opposite the notch of the hook and butts against the slide on the ski.

11. Binding according to claim 2, characterized in that the rigid retention means of the brake frame comprises one or more tabs shaped like a hook with a notch.

12. Binding according to claim 2, characterized in that the fixed element integrated with the base comprises one or more projections oriented perpendicularly in relation to the plane of the base.

13. Binding according to claim 3, characterized in that the fixed element integrated with the base comprises one or more projections oriented perpendicularly in relation to the plane of the base.

14. Binding according to claim 4, characterized in that the fixed element integrated with the base comprises one or more projections oriented perpendicularly in relation to the plane of the base.

15. Binding according to claim 6, characterized in that the free end of the two projections fits into the structure of the base.

16. Binding according to claim 4, characterized in that the base also comprises a reinforcement frame fastened to the base so as to delimit a housing in which the tabs engage by insertion.

17. Binding according to claim 5, characterized in that the base also comprises a reinforcement frame fastened to the base so as to delimit a housing in which the tabs engage by insertion.

18. Binding according to claim 6, characterized in that the base also comprises a reinforcement frame fastened to the base so as to delimit a housing in which the tabs engage by insertion.

19. Binding according to claim 7, characterized in that the base also comprises a reinforcement frame fastened to the base so as to delimit a housing in which the tabs engage by insertion.

20. Binding according to claim 4, characterized in that one of the tabs also comprises a supplementary protuberance which is arranged on the external side opposite the notch of the hook and butts against the slide on the ski.

21. Binding according to claim 5, characterized in that the rigid retention means of the brake frame comprises one or more tabs shaped like a hook with a notch, one of said tabs also comprising a supplementary protuberance which is arranged on the external side opposite the notch of the hook and butts against the slide on the ski.

22. Binding according to claim 6, characterized in that the rigid retention means of the brake frame comprises one or more tabs shaped like a hook with a notch, one of said tabs also comprising a supplementary protuberance which is arranged on the external side opposite the notch of the hook and butts against the slide on the ski.

23. Binding according to claim 7, characterized in that the rigid retention means of the brake frame comprises one or more tabs shaped like a hook with a notch, one of said tabs also comprising a supplementary protuberance which is arranged on the external side opposite the notch of the hook and butts against the slide on the ski.

24. Binding according to claim 8, characterized in that one of the tabs also comprises a supplementary protuberance which is arranged on the external side opposite the notch of the hook and butts against the slide on the ski.

25. Binding according to claim 9, characterized in that one of the tabs also comprises a supplementary protuberance which is arranged on the external side opposite the notch of the hook and butts against the slide on the ski.

* * * * *